United States Patent [19]

White

[11] 4,143,465

[45] Mar. 13, 1979

[54] SIGHTING DEVICE

[76] Inventor: Jerrie L. White, 3025 Stover St., Ft. Collins, Colo. 80521

[21] Appl. No.: 828,279

[22] Filed: Aug. 29, 1977

[51] Int. Cl.[2] ..... F41G 1/46

[52] U.S. Cl. ..... 33/233; 33/244

[58] Field of Search ..... 42/1 S; 33/233, 244, 33/242, 243, 261

[56] References Cited

U.S. PATENT DOCUMENTS

| | | | |
|---|---|---|---|
| 2,118,878 | 5/1938 | Bowman | 151/21 R |
| 2,231,130 | 2/1941 | Lehre | 151/21 R |
| 2,479,277 | 8/1949 | Terhaar | 33/244 |
| 3,107,450 | 10/1963 | Snyder et al. | 33/233 X |
| 3,171,226 | 3/1965 | Into | 33/233 X |
| 3,325,937 | 6/1967 | Morrow | 33/233 |
| 4,010,564 | 3/1977 | Pettit | 33/233 |

*Primary Examiner*—William D. Martin, Jr.
*Attorney, Agent, or Firm*—Hugh H. Drake

[57] ABSTRACT

A sighting device mounts upon a flat horizontal web secured along the top of the barrel of a gun. It is composed of an elongated vertically-oriented strip which includes a plurality of downwardly-projecting ears individually spaced along the length of the strip. A corresponding plurality of blocks mount the ears respectively to different successive portions of the web.

9 Claims, 6 Drawing Figures

SIGHTING DEVICE

The present invention pertains to a sighting device for a gun. More particularly, it relates to an attachment to a conventional shotgun or the like which enables improved efficiency of aiming.

Of course, it is well known to include sighting devices on weapons. Quite typically on rifles, a front sight is located near the muzzle and takes the form of a post or bead. At the rear of the barrel is another upwardly-projecting structure, such as a V-shaped notch, a peephole or some other type of recess, which is aligned with the front sight for the purpose of aiming the weapon toward a target. In shotguns, it is typical to provide an upstanding bead on top of the barrel near the muzzle. In one well-known approach, a depression is formed in the top of the barrel near its rear. The rearward depression serves as an optical guide for alignment with the forward bead when using the gun. However, that rear depression normally is not used precisely like a rear sight on a rifle so as to achieve accurate optical aiming toward the target. Instead, the combination of the front bead and the rear groove is used more as an aid to what is called "pointing" of the gun toward the target. That is, they are optically-related guides associated by the eye as part of the total process of swinging the gun along with movement of the target so as to enable the delivery of a proposed shot to a point designed to bring down the target.

Instead of, or in addition to, the aforementioned rearward groove at the top of the barrel, an improvement has been the inclusion above the barrel of a rib which is secured along the top of the barrel. The rib is in the form of a flat horizontal web and typically is secured to the barrel by a plurality of struts spaced successively along its length. Those struts enable ventilation between the rib and the barrel for the purpose of cooling. Upon repeated shooting, the excessive heat otherwise might obscure the vision of the shooter.

At least for some users, the presence of the rib is thought to aid in the pointing of the gun toward the target. It is sort of a continuous sighting device that may cause the eye better to orient the position of the barrel relative to the target. Nevertheless, the experienced shooter tends to rely primarily on the position of the front bead as it relates to the position of the target. In pursuing wildfowl or in the competition of skeet shooting, it is rather generally agreed that the provision of a sight of a definitive nature, like in rifles, is too confining. Apparently, the inclusion of a precision sight so confines the focused field of view that the shooter is unable to perform satisfactorily in moving the gun into an on-target position within the time limit usually allowed. The aforementioned addition of a rib on top of the barrel has been a somewhat successful attempt to enable a greater accuracy of pointing of the gun without yet restricting the user to having to focus a rear sight upon both the front sight and the target.

Given all this, the experienced shooter learns that, for a given gun, he can learn to point the muzzle end of his barrel, as helped by the bead usually upstanding therefrom, in a given direction and achieve a desired result. For each different gun, that may take a lot of practice. While the inclusion of a ventilated rib is of assistance, the result still often is one of having first to practice enough to get the "feet" of a particular gun.

It is a general object of the present invention to provide a new and improved sighting device that augments the top-mounted rib and enables a more quickly attained accurate result in terms of pointing.

Another object of the present invention is to provide a new and improved sighting device which is removably adaptable to existing guns.

A further object of the present invention is to provide such a device which, although capable of being applied in precisely pre-determined relationships to the barrel of the gun, may be manufactured with economy and yet be rugged in character.

Thus, the invention pertains to a sighting device for mounting above the barrel of a gun. On that barrel is a flat horizontal web of pre-determined thickness and width. An elongated vertically-oriented strip is of a length which corresponds to a substantial portion of the length of a barrel and the rib. The strip includes a plurality of downwardly-projecting ears individually spaced successively along the length of the strip. A corresponding plurality of blocks are provided for mounting the ears respectively to different successive portions of the strip. Each of the blocks includes means for fastening the block to the strip and for clamping the block to the web.

The features of the present invention which are believed to be novel are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figures 1, 2, 3, 4, 5, 6:
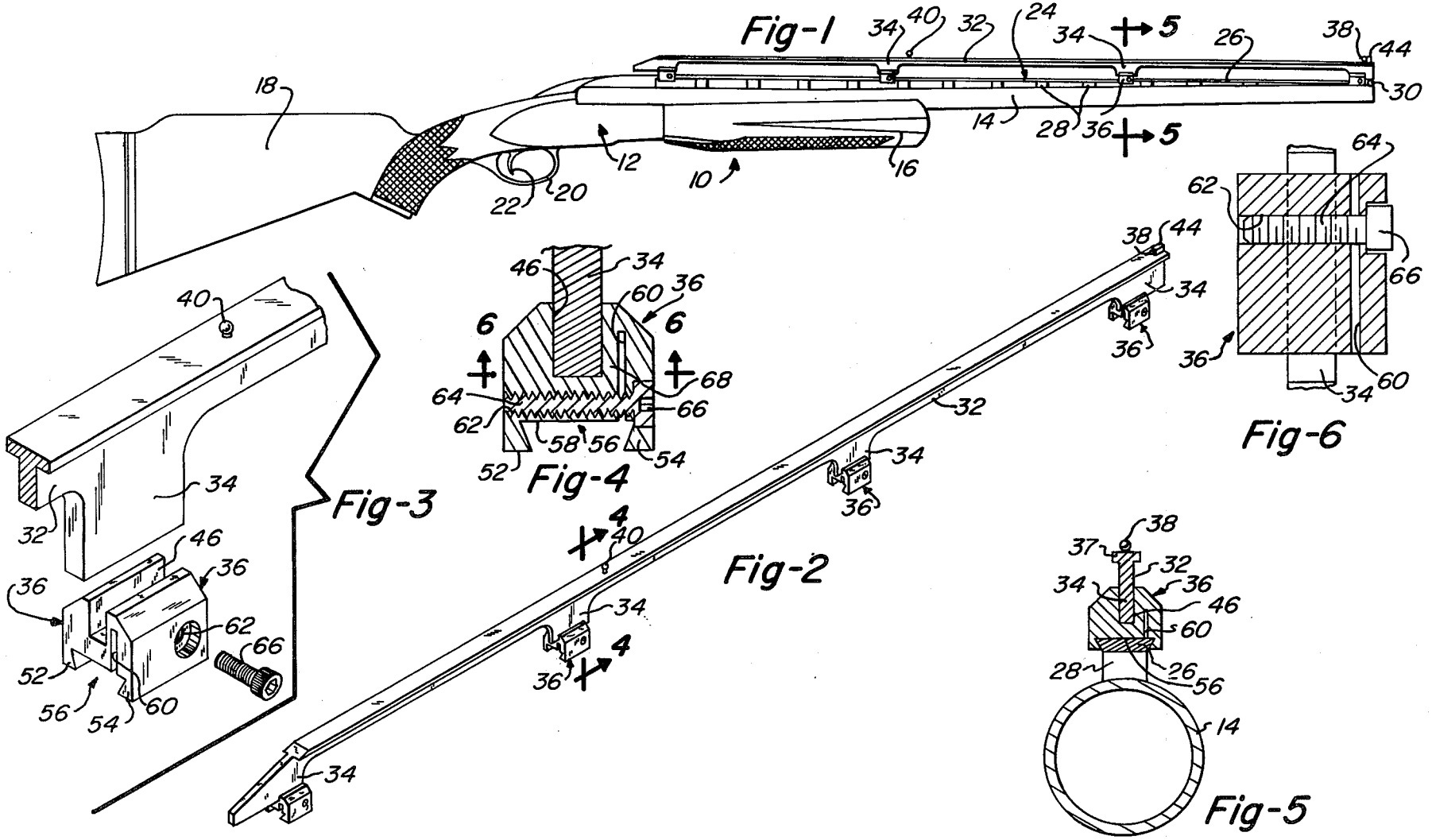
FIG. 1 is a side-elevational view of a shotgun incorporating a sighting device in accordance with the present invention.
FIG. 2 is a perspective view of the sighting device included in FIG. 1.
FIG. 3 is a fragmentary, exploded perspective view of a portion of the device shown in FIG. 2.
FIG. 4 is a fragmentary cross-sectional view taken along the line 4—4 in FIG. 2.
FIG. 5 is a cross-sectional view taken along the line 5—5 in FIG. 1.
FIG. 6 is a cross-sectional view taken along the line 6—6 in FIG. 4.

FIG. 1 depicts a shotgun 10 that has the usual stock 12 which seats a barrel 14 and provides a hand grip 16 together with a butt 18 engageable with the shoulder of the user. A trigger guard 20 encircles a trigger 22 which is depressable to activate a firing mechanism (not shown) at the rear end of barrel 14. The result of actuation of trigger 22 is to cause a cartridge to deliver propulsion to a shot charge delivered through barrel 14.

Secured along the top of barrel 14 is a rib 24 which runs lengthwise along the barrel. Rib 24 is composed of a flat horizontal web 26 of its own defined thickness and width and which is secured to barrel 14 by a successive plurality of posts 28. Normally provided at the muzzle end of barrel 14 is an upstanding bead 30 for the purpose of aiding in pointing as mentioned in the introduction. As so far described, the gun and its various elements are entirely conventional. Moreover, its different features of construction may vary widely. The general arrangement is such as has been used for years in the shooting of targets which may include either so-called clay pigeons as employed in skeet shooting or in the pursuit of wildfowl.

In this case added to the assembly is an additional sighting device which includes an elongated vertically-oriented strip 32 of a length corresponding at least to a substantial portion of the lengths of barrel 14 and rib 24. Projecting downwardly from strip 32 are a plurality of ears 34 individually spaced successively along the length of strip 32. A corresponding plurality of blocks 36 serve to mount ears 34 respectively to different successive portions of rib 24. Each block 36 includes means for fastening the respective block to strip 32 and also for clamping the block to web 26. Preferably, strip 32 is of T-shaped cross-section so as to define an uppermost horizontal flat portion 37.

Also preferably included on strip 32 is a first bead 38 which projects upwardly from flat 37 at the top margin of strip 32 adjacent to the forward end thereof. A second bead 40 also projects upwardly from flat 37 and is located substantially toward the rear end of strip 32. A post 44 also projects upwardly from flat 37 at the top margin of strip 32 and is disposed immediately forward of first bead 38. Post 44 serves to protect bead 38 against dislodgment as the forward end of the gun might be touched against other objects when in non-shooting manuvering.

Each of blocks 36 includes an upwardly-facing vertical channel 46 in which a corresponding one of ears 34 is seated. Each block 36 also includes a pair of downwardly projecting wedge-shaped feet 52 and 54 individually disposed along respective opposite sides of the block. Feet 52 and 54 together define a dove-tailed channel 56 on the bottom side of block 36 and of a size nominally to receive web 26. Extending upwardly from the top wall 58 of channel 56 is a vertical slot 60. Slot 60 extends substantially above the bottom of channel 46. Extending horizontally through block 36 is a hole 62 which continues across slot 60. Inner portion 64 of hole 62 is threaded. A screw 66 is threaded into hole 62 and across slot 60 so as to permit squeezing together of the vertical side walls of slot 60 and thereby clamp feet 52 and 54 upon the side margins of web 26. At the same time, the common wall portion 68, between channel 46 and slot 60 is flexed sufficiently that ear 34 is also clamped within channel 46. In an alternative, an opening may extend upwardly from the top wall of channel 58, with a screw being threaded into the bottom of ear 34 for fastening the latter within channel 46.

Upon slightly loosening screws 66, the elevation of ears 34 within different respective ones of channels 46 can be varied. In this way, a quick adjustment of the point of impact is available. Using an otherwise conventional shotgun, it has been found that such adjustment can effect a change of plus or minus ten inches at forty yards.

Lateral alignment is assured, because all mounting is relative to the already-present ventilated rib. Visibility of the target is enhanced by reason of the increased height of the device above the barrel; that reduces the effect of heat waves. Preferably, strip 32 is anodized to a black color, and beads 38 and 40 are of an ivory color. No drilling, tapping or cementing is required for adequate mounting.

In use, the sighting device described as mounted upon a shotgun appears to enable the user to be more accurate in his pointing of a shotgun. At the same time, it is to be recognized that this is not precisely the same optical phenomenon that exists in the aiming of a precision rifle. With the required approach to shooting as involved with a shotgun, the user still has to point, rather than aim, in order to achieve success as against a fleeting target. The sighting device described tends to aid inherently in achieving the coordination required between observation and gun movement for accurate shooting toward a moving target. At the same time, the additional device offers the utmost of simplicity in fabrication and assembly to the gun. Preferably, all parts are metallic, with aluminum being desired for its combination of light weight and rigidity. However, a fiberglass or plastic might be substituted if sufficiently durable and otherwise suitable for the purpose.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. For mounting above the barrel of a gun having a rib secured along the top of the barrel and including a flat horizontal web of pre-determined thickness and width, a sighting device comprising:

an elongated vertically-oriented strip of a length corresponding to a substantial portion of the lengths of said barrel and rib, said strip including a plurality of downwardly-projecting ears individually spaced successively along the length of said strip;

and a corresponding plurality of blocks for mounting said ears respectively to different successive portions of said strip, each of said blocks including means for fastening the block to said strip and for clamping the block to said web.

2. A device as defined in claim 1 which further includes a first bead projecting upwardly from the top margin of said strip adjacent to the forward end thereof and a second bead projecting upwardly from said margin substantially toward the rear end thereof from said forward end.

3. A device as defined in claim 2 which also includes a post projecting upwardly from said margin immediately forward of said first bead.

4. A device as defined in claim 1 in which each of said blocks includes a pair of downwardly-projecting wedged-shaped feet individually disposed along respective opposite sides of said block, said feet together defining a dove-tailed channel on the bottom side of the block and of a size nominally to receive said web between said feet.

5. A device as defined in claim 4 which includes:

means defining a vertical slot extending upwardly from the top wall of said channel;

means defining a hole extending horizontally through the block and across said slot, the portion of said hole on one side of said slot being threaded;

and a screw threaded into said hole and across said slot for squeezing together the walls of said slot and thereby clamping said feet upon said web.

6. A device as defined in claim 5 which also includes:

means defining an upwardly-facing vertical channel in each of said blocks and in which a corresponding one of said ears is seated;

said slot extending substantially above the bottom of said channel;

and said squeezing of said wall also effecting a clamping of the ear within the channel.

7. A device as defined in claim 1 which includes:

means defining an upwardly-facing vertical channel in each of said blocks and in which a corresponding one of said ears is seated;

means defining a vertical slot extending upwardly from a bottom portion of the block, said slot extending substantially above the bottom of said channel and defining a common wall portion between said channel and said slot;

means defining a hole extending horizontally through said block and across said slot, the portion of said hole on one side of said slot being threaded;

and a screw threaded into said hole and across said slot for squeezing together the walls of said slot and flexing said common wall portion to clamp the associated ear within said channel.

8. A device as defined in claim 1 in which said strip is of T-shaped cross-section so as to define an uppermost horizontal flat portion.

9. A device as defined in claim 1 in which said fastening means is arranged to enable selective adjustment of the elevation of each of said ears above said barrel.

* * * * *